United States Patent [19]

Jeremić

[11] 4,125,045

[45] Nov. 14, 1978

[54] SHEET PUNCHING MACHINE

[75] Inventor: Miroslav Jeremić, Belgrade, Yugoslavia

[73] Assignee: Kerason SA, Romanel, Switzerland

[21] Appl. No.: 806,067

[22] Filed: Jun. 13, 1977

[51] Int. Cl.[2] ..... B21D 28/26; B26F 1/06

[52] U.S. Cl. ..... 83/389; 83/588; 83/590; 83/618

[58] Field of Search ..... 83/588, 590, 551, 550, 83/549, 512, 510, 618, 622, 389

[56] References Cited

U.S. PATENT DOCUMENTS

| | | | |
|---|---|---|---|
| 2,137,716 | 11/1938 | Faas | 83/588 |
| 2,327,646 | 8/1943 | Hutchinson | 83/550 |
| 3,228,275 | 1/1966 | Taber | 83/588 |
| 3,230,812 | 1/1966 | Pucci et al. | 83/588 |
| 3,301,110 | 1/1967 | Stegner | 83/622 X |
| 3,570,341 | 3/1971 | Abbott, Jr. | 83/512 X |
| 3,581,617 | 6/1971 | Lysobey | 83/512 |
| 3,808,933 | 5/1974 | Buan | 83/588 |

*Primary Examiner*—J. M. Meister

*Attorney, Agent, or Firm*—Hopgood, Calimafde, Kalil, Blaustein & Lieberman

[57] ABSTRACT

A sheet punching machine comprising a support for the sheet to be punched and a punch carrier carrying a multiplicity of punches, together with means for forcing the punches through the sheet; said means are so arranged as to press the punches successively, one after the other, through the sheet, and return means are provided to return to their starting position the punches which have passed through the sheet. The means of forcing the punches may comprise two parallel endless chains mounted on two pairs of coaxial toothed wheels fixed in rotation in pairs, at least one transverse shaft fixed to the two chains and carrying a working roller and two running rollers, and two rectilinear support surfaces for the running rollers, the punches being axially movable at least approximately perpendicularly to the trajectory of the rollers and having a part which intersects the horizontal path of the working roller when the running rollers run on the said support surfaces, the return means for the punches being elastic.

4 Claims, 5 Drawing Figures

Fig. 4
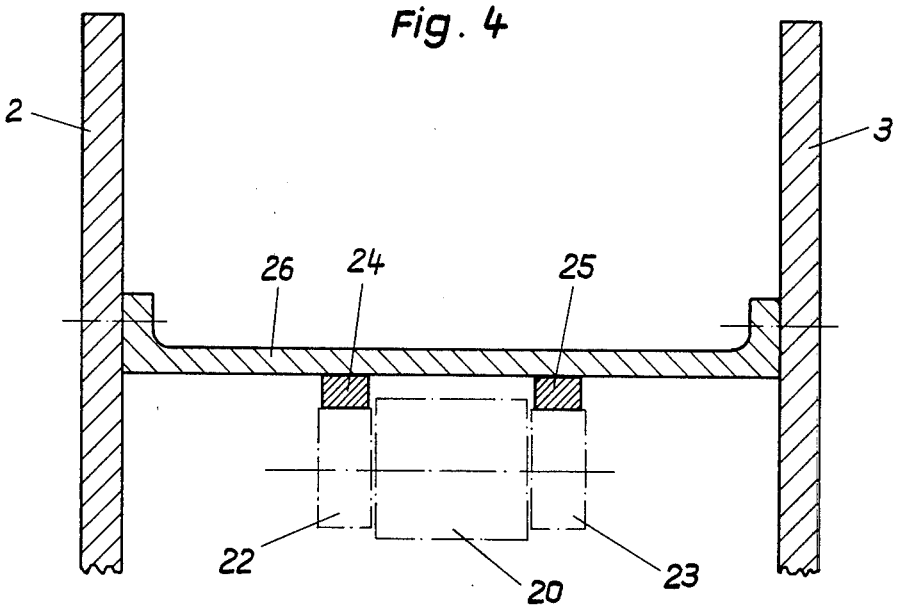
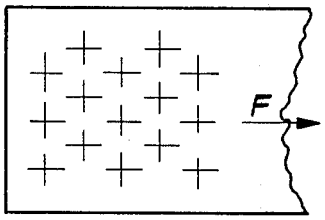
Fig. 5
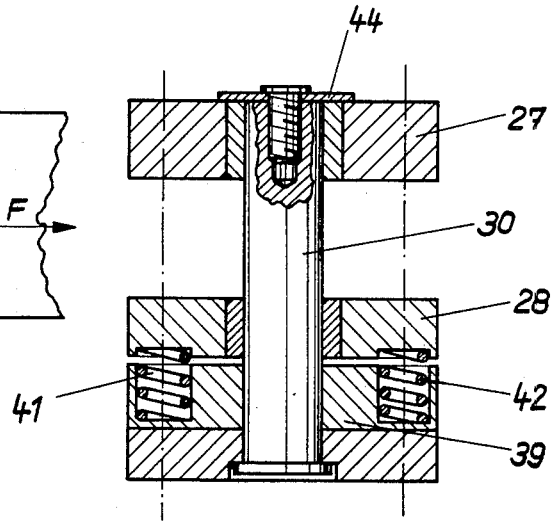
Fig. 3

SHEET PUNCHING MACHINE

The present invention relates to a sheet punching machine comprising a support for the sheet which is to be punched and a punch carrier carrying a multiplicity of punches, together with means for forcing the punches through the sheet.

Perforated sheets are used in numerous fields of technology and building. Sheets of a thickness of from 0.5 to 0.75 mm are in particular used for covering ceilings of industrial or public premises. For the perforation of these sheets conventional presses have hitherto been used, for example presses developing a force of 30 tonnes and capable of piercing 120 holes at a time. These presses are bulky, very heavy, and very expensive machines.

The present invention seeks to attain the same result, with the same rate of working, by means of a light machine of small size which utilises only a much smaller force.

The sheet punching machine of the invention is characterized by the fact that the aforesaid means are so arranged as to press the punches successively, one after the other, through the sheet, and that return means are provided to return to their starting position the punches which have passed through the sheet.

In a preferred embodiment the punch forcing means comprise two parallel endless chains mounted on two pairs of coaxial toothed wheels which are fixed in rotation in pairs, at least one transverse shaft fixed to the two chains and carrying a working roller and two running rollers, and two rectilinear support surfaces for the running rollers, the punches being axially movable at least approximately perpendicularly to the trajectory of the rollers and having a part which intersects the horizontal path of the working roller when the running rollers run on the said support surfaces, and the punch return means being elastic, and further comprising dies cooperating with each punch, and means of gripping the sheet to be punched which are adapted to be operated by the working roller, the whole arrangement being such that the working roller operates the punches successively, at the rate of at least one punch at a time, during its displacement when the running rollers run on the said support surfaces.

It is preferred to use two working rollers mounted symmetrically on the chains and working alternately, the sheet being advanced between the end of the horizontal movement of one roller and the commencement of the horizontal movement of the other roller. It is thus possible, for example, to pierce 105 holes of a diameter of 3 mm during a single travel of a roller acting on 105 punches equipping a machine of a length of 600 mm which is operated by a 3CV motor, the weight of the machine being of the order of 200 to 250 kg. It is thus possible to produce a machine whose weight and dimensions are not comparable with those of a conventional press; a machine of this kind can easily be transported. Since the rollers move in a continuous non-reciprocating movement, it is possible to attain a high working rate which in all cases is equal to that of a conventional press.

The accompanying drawings illustrate by way of example one embodiment of the invention.

FIG. 3 is a partial view in section on the line III—III in FIG. 1,

FIG. 4 is a partial view in section on the line IV—IV in FIG. 1, and

FIG. 5 shows diagrammatically the position of the punches, viewed in plan.

Figure 1:
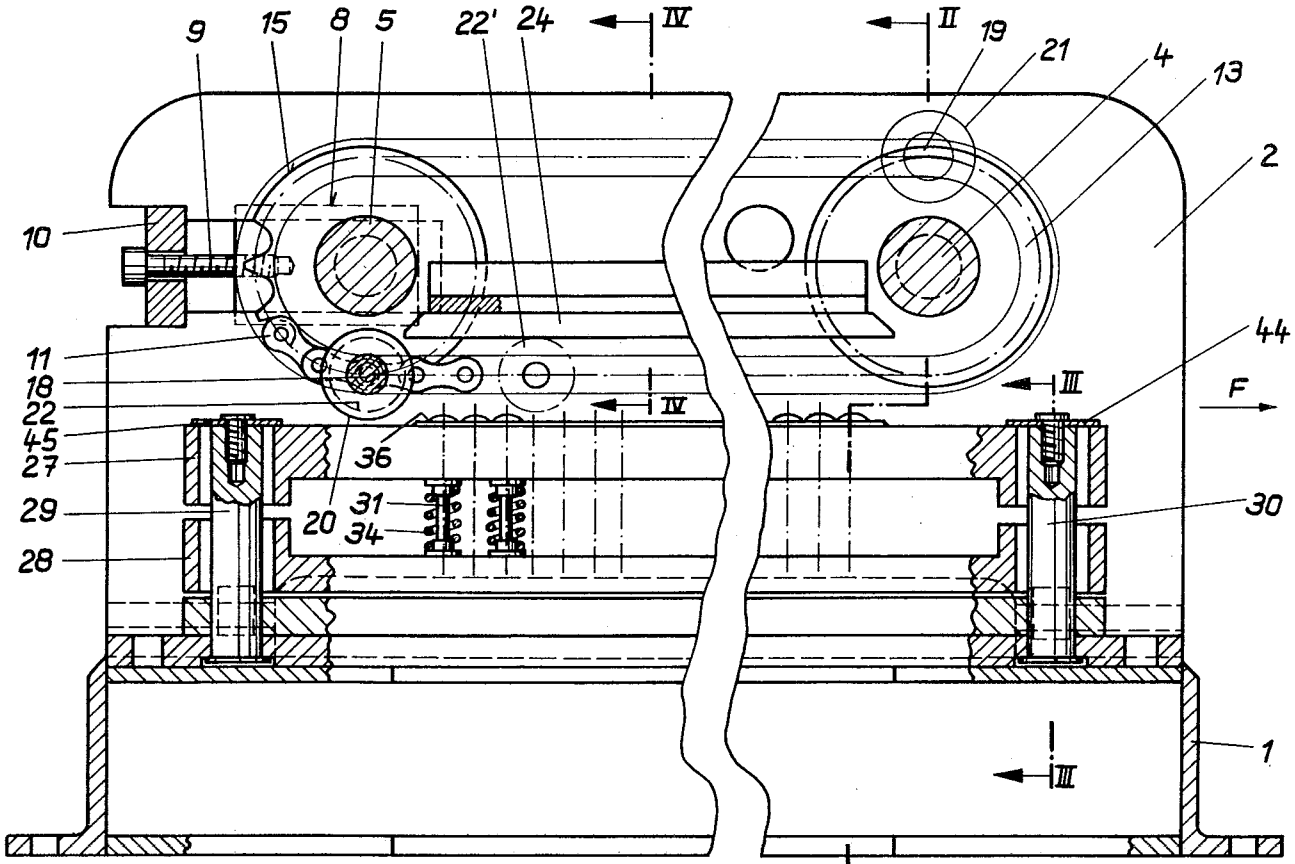
FIG. 1 is a view in elevation and in section on the line I—I in FIG. 2.
Figure 2:
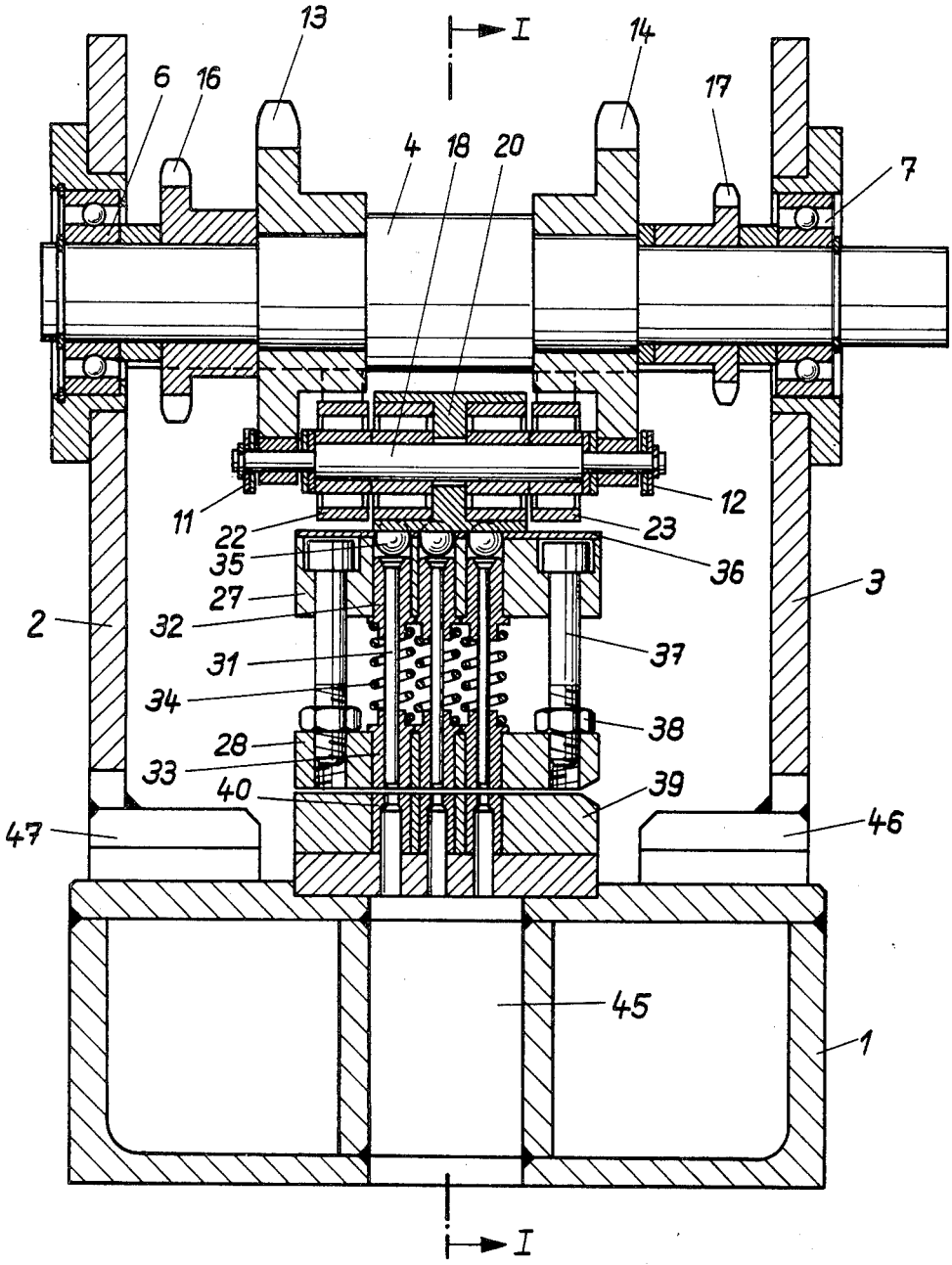
FIG. 2 is a view in elevation and in section on the line II—II in FIG. 1.

The machine illustrated comprises a frame 1 intended to be disposed and fixed on a base (not shown). Two shafts 4 and 5 are pivoted between two vertical plates 2 and 3 of the frame. The shaft 4 turns in two ball races 6 and 7 fixed in the plates 2 and 3, while the ball races supporting the shaft 5 are mounted in a movable support 8 slidable in the frame and retained by a bolt 9 bearing against a cross-member 10 in order to permit adjustment of the tension of two endless chains 11 and 12 mounted parallel on two pairs of toothed wheels, each of these pairs being mounted on one of the shafts 4 and 5 respectively. FIG. 2 shows the two toothed wheels 13 and 14 fixed on the drive shaft 4, while one of the toothed wheels 15 fixed on the shaft 5 is visible in FIG. 1. The drive shaft 4 also carries a pinion 16 fixed on the shaft and intended to mesh with the pinion of a motor (not shown), as well as with a second pinion 17 for the synchronous driving of a sheet advance device, which is not shown and which is known per se.

Two identical shafts 18 and 19 are fixed between the chains transversely and symmetrically in relation to the centre of the loops formed by the chains. On each of these shafts a roller 20, 21 respectively is mounted in a roller bearing. To meet the requirements of the description the shaft 18 has been shown in two different positions in FIGS. 1 and 2. Each of the shafts 18 and 19 also carries two running rollers 22 and 23, which are likewise mounted on rollers and intended to roll and be supported on two horizontal support surfaces formed by two rectilinear bars 24 and 25 fixed above the rollers on a transverse plate 26 of the frame (FIG. 4).

The machine is also provided with two horizontal plates 27 and 28 mounted for sliding on two vertical guide columns 29 and 30 fixed in the frame. The movable plates 27 and 28 carry punches, of which there are 105 in this example, and which are disposed in groups of three punches aligned transversely of the direction of displacement F of the rollers. FIG. 5 shows diagrammatically the arrangement of these punches in the direction F. Each punch 31 is fastened by its top end, which is provided with a head, to a bronze cylindrical member 32 adapted to slide in a bore formed in the top plate 27. The bottom part of the punch slides in a bronze sleeve 33 driven into the bottom plate 28. A spring 34 working in compression between the parts 32 and 33 serves to return the member 32 in the upward direction. On the head of the punch is placed a ball 35 of which the lower portion half projects above a retaining plate 36 fixed on the plate 27.

It is thus seen that the springs 34 urge the plates 27 and 28 apart, this movement being limited by the bolts 37 screwed into the bottom plate 28 and holding the plate 27 by their heads. These bolts are locked by nuts 38. They also serve to determine and permit the adjustment of the spacing of the plates 27 and 28 and consequently the position of the bottom plate 28 in relation to the top of the columns 29 and 30, that is to say the spacing in the position of rest of the plate 28 and of a fixed plate 39 in which are mounted cutting dies 40 cooperating with each of the punches 31. This spacing is selected in accordance with the thickness of the sheet to be punched. Four helicoidal springs such as 41 and 42 (FIG. 3) working in compression are mounted between the plate 39 and the plate 28 to maintain this spacing in the position of rest, while enabling the bottom plate 28 to be used as a blank holder. Through the action of the springs 41 and 42 the top plate 27 comes to bear against small plates 44 and 45 retained by screws at the end of each of the columns 29 and 30. A certain axial play is provided between the heads of the bolts 37 and the retaining plate 36 in such a manner as to provide the necessary compressibility of the assembly comprising the plates 27 and 28 during the clamping of the sheet. The frame also has an outlet 45 for the discharge of scrap beneath the dies 40, and two passages 46 and 47 for the sheet.

The operation of the machine is as follows:

The sheet to be perforated having been introduced between the plates 28 and 39, the machine is put into operation and the running rollers 22 and 23 start to roll on the support bars 24 and 25. Simultaneously or immediately thereafter one of the working rollers, for example the roller 20, comes into contact with the sloping end of the plate 36, which has the effect of pushing the plates 27 and 28 downwards, so that the plate 28 clamps and holds the sheet which is to be perforated. Immediately after this the roller 20 encounters the first three balls 35 and pushes these balls down, simultaneously driving the first three punches. The other punches are operated in succession in groups of three as far as the end of the plate 36. When the roller 20 has reached the end of its horizontal travel the pressure on the sheet is relaxed and the sheet can be advanced, manually or automatically, while the other working roller 21 is displaced a half-circle on the toothed wheel 15, so as to assume the position of the roller 20 shown in FIG. 1. Further perforation of the sheet is then effected by the roller 21.

In view of the fact that when the working roller presses against the balls the bottom sheet 28 tends to move downwards together with the punches, the clamping of the sheet could be effected directly by the action on the balls. All that is required is for the springs 34 to be more powerful than the springs 41 and 42.

The machine can obviously function with a single working roller, which would allow more time for the advance of the sheet.

As an alternative the balls could be eliminated, in which case the rollers would act directly on the heads of the punches.

For the same power of the motor the number of punches operated in succession is theoretically unlimited. It is sufficient to increase the length of the machine while its other dimensions remain the same. The number of punches operated simultaneously is on the other hand dependent on the power of the machine.

In the machine described above the means of forcing the punches comprise essentially two chains with rollers. In another embodiment, not illustrated, these means could be composed of a piston operated for example by a connecting rod and making a horizontal reciprocating movement. This piston would then act on the punches, forcing them through the sheet one after the other.

What is claimed is:

1. A sheet punching machine comprising a support for the sheet to be punched and a punch carrier carrying a multiplicity of punches, together with means for forcing the punches through the sheet, means for returning, to a starting position, said punches which have forced through the sheet, said forcing means comprising two parallel endless chains, mounted on two pairs of coaxial toothed wheels, fixed in rotation in pairs, a first transverse shaft fixed to the two chains and carrying a working roller, two running rollers, and two rectilinear support surfaces for the running rollers, said punches being axially movable at least approximately perpendicularly to the trajectory of said rollers and having a part which intersects the horizontal path of said working roller when said running rollers run on the said support surfaces, said returning means being elastic, and further comprising, dies cooperating with each punch, means for clamping the sheet to be punched, said clamping means being adapted to be operated by the working roller, said chains carrying a second transverse shaft mounted symmetrically to said first transverse shaft and carrying identical rollers, said punches being mounted in two superimposed plates, said plates adaptably mounted for sliding on vertical columns and fastened to one another at least during a greater part of their displacement, the part of the punches intersecting the path of the working roller being comprised of a ball projecting above the upper plate, the clamping means being comprised of the bottom plate and a fixed plate carrying said dies, and elastic means, working in compression, being disposed between said fixed plate and said bottom plate, whereby said working roller operates the punches in succession, at the rate of at least one punch at a time, during its displacement, when the running rollers run on the said support surfaces.

2. A machine according to claim 1 further comprising means for permitting the adjustment of the spacing of the two sliding plates and consequently of the space between the movable bottom plate and the fixed plate.

3. A machine according to claim 1, further comprising a sheet advance device connected kinematically to said chains.

4. A machine according to claim 1 further comprising a plurality of punches aligned on a straight line parallel to the shaft carrying the rollers.

* * * * *

UNITED STATES PATENT OFFICE

CERTIFICATE OF CORRECTION

Patent No. 4,125,045 Dated November 14, 1978

Inventor(s) Jeremic Miroslav

It is certified that error appears in the above-identified patent and that said Letters Patent are hereby corrected as shown below:

On the first page of the patent between the listings for Application No. 806,067 and U.S. Classification, the following claim of priority should be listed:

[30] Foreign Application Priority Data

June 22, 1976 Switzerland.....7929/76

Signed and Sealed this

*Twenty-ninth* Day of *May 1979*

[SEAL]

*Attest:*

RUTH C. MASON
*Attesting Officer*

DONALD W. BANNER
*Commissioner of Patents and Trademarks*